US005405237A

United States Patent [19]

Oka

[11] Patent Number: 5,405,237

[45] Date of Patent: Apr. 11, 1995

[54] LOADER LEVELING LINKAGE PROVIDING FOR ALTERATION OF ITS GEOMETRY FOR ACCOMMODATING DIFFERENT IMPLEMENTS

[75] Inventor: Ken K. Oka, St. Catharines, Canada

[73] Assignee: Deere & Company, Moline, Ill.

[21] Appl. No.: 185,093

[22] Filed: Jan. 21, 1994

[51] Int. Cl.[6] ..... E02F 3/28

[52] U.S. Cl. ..... 414/685; 414/722; 414/912; 414/917

[58] Field of Search ..... 414/685, 686, 917, 912, 414/722; 37/347, 403

[56] References Cited

U.S. PATENT DOCUMENTS 3,155,253 11/1964 Pilch .
3,966,070 6/1976 Barth .
3,995,756 12/1976 Hjeim ..... 414/971 X

FOREIGN PATENT DOCUMENTS 2928278 1/1981 Germany .

OTHER PUBLICATIONS

Bomford Turner Ltd. literature, 2 pages, undated, describing the Bomford Loader Model B3518 marketed by Bomford Turner Ltd. of Great Britain.

*Primary Examiner*—Donald W. Underwood

[57] ABSTRACT

A tractor-mounted loader is provided with a leveling linkage including a pivot arm assembly pivotally mounted to each of a pair of loader arms at locations intermediate the ends of the latter. A first link is coupled between each post supporting the loader boom arm on the tractor and the pivot arm assembly while a tilt cylinder serves as a second link and is coupled between the pivot arm assembly and a tilt linkage for the implement. The pivot arm assembly of each linkage includes a pair identical plates fixed in spaced parallel relationship to each other and each plate contains an elongate pivot pin adjustment slot having the mounting pin for the tilt cylinder located therein. A releasable latch is provided for latching the mounting pin in a rear end of the slot to establish a first leveling linkage geometry desired for use with a loader bucket, the releasable latch being movable to an unlatched position permitting the mounting pin to move to a forward end of the slot for establishing a second leveling linkage geometry desired for use with a fork lift.

19 Claims, 4 Drawing Sheets

Fig. 4
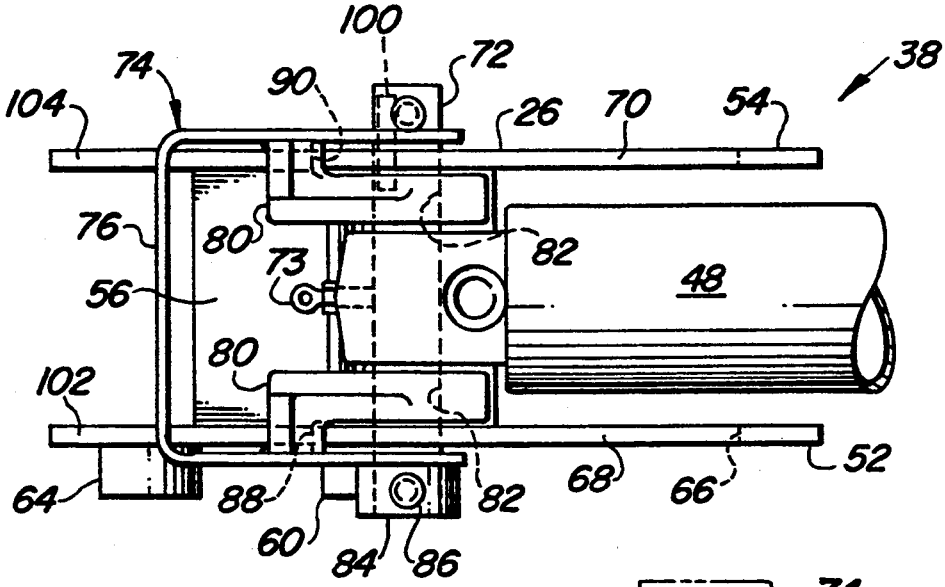
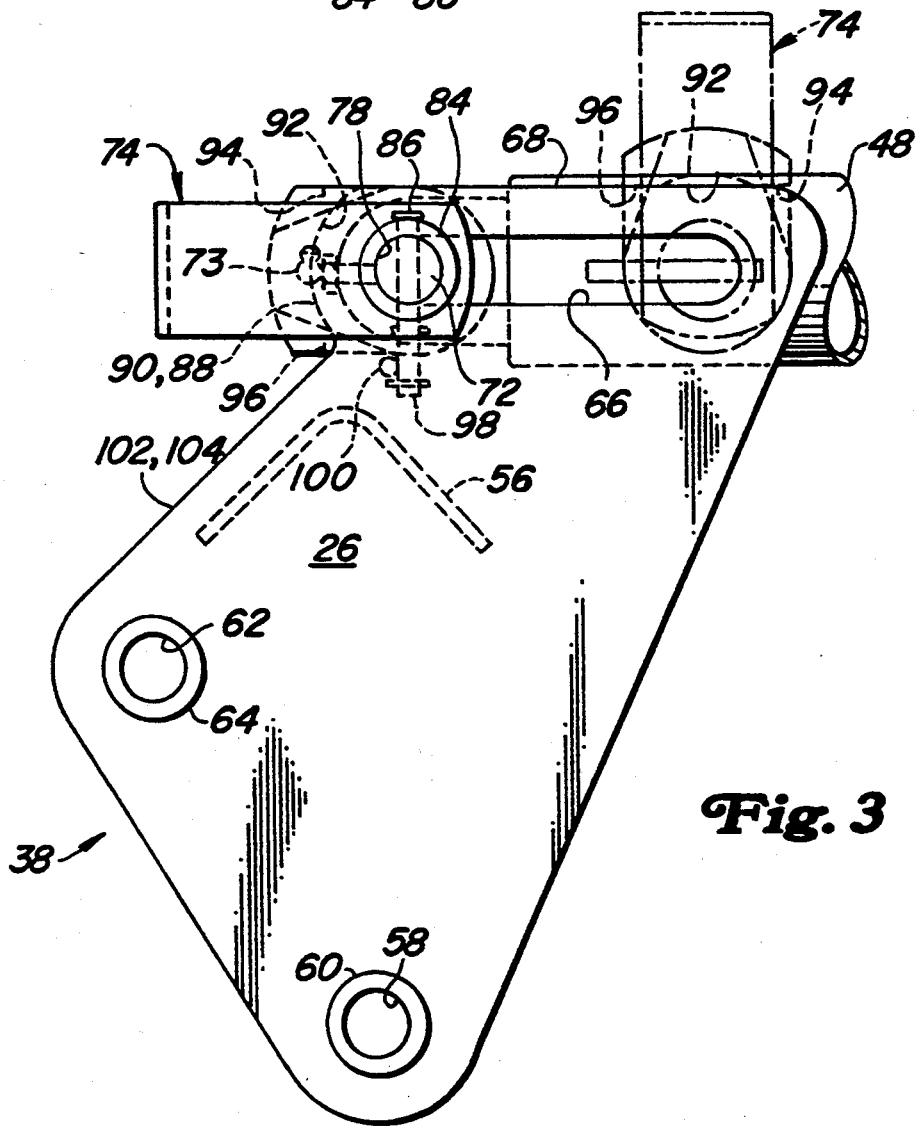
Fig. 3

LOADER LEVELING LINKAGE PROVIDING FOR ALTERATION OF ITS GEOMETRY FOR ACCOMMODATING DIFFERENT IMPLEMENTS

BACKGROUND OF THE INVENTION

The present invention relates to tractor-mounted loaders and more particularly relates to leveling linkages for the implements attached to the arms of such loaders.

The desired leveling characteristics of various attachments adapted for connection to the arms of tractor-mounted loaders are not the same. For example, fork lifts must remain near level at all lift heights, whereas buckets should roll back slightly (never forward) as it is raised. Therefore, separate leveling linkage geometries are required for forklift and bucket applications.

The prior art recognizes the above-noted requirement of separate leveling linkage geometries. Specifically, in some leveling linkages which utilize a so called cross-over link, it is known to provide the link with adjustment holes to which the end of a link, forming part of the leveling linkage, may alternately be attached to change the way the leveling linkage acts on the implement to automatically change the attitude of the latter relative to the lift arms as the arms are raised and lowered. U.S. Pat. No. 3,966,070 granted 29 Jun., 1976 shows a representative structure of this type.

Some prior art loader arms are in an angular form having a knee to which a knee or pivot plate assembly forming part of the leveling linkage is pivotally attached, the plate assembly having a further pair of attachment points respectively attached to a pair of further leveling link components. In one of these known leveling linkage designs, the knee or pivot plate assembly can be disconnected from the arm knee, rotated 180° about a vertical axis and reconnected to the arm knee to convert the linkage between a first arrangement for operating a fork lift and a second arrangement for operating a bucket. An example of such a linkage is disclosed in German Patent No. 2928278, granted 29 Jan. 1981. In another leveling linkage of this type, the pivot connection for one of the links attached to the knee plate assembly is carried by an eccentric which is rotatable between a first position for establishing a first linkage geometry for operation with a fork lift and a second position for establishing a second linkage geometry for operation with a bucket. Such a knee plate assembly is incorporated in the Model B3518 loader marketed by Bomford Turner Ltd. of Great Britain.

The prior art attempts at providing leveling linkages for accommodating the leveling needs of different attachments have one or more of the drawbacks of requiring pins to be removed and reinserted while manipulating relatively heavy leveling linkage components, or, as in the case of the eccentric, of not affording sufficient change in the geometry of the linkage for accommodating the change necessary for many loader designs.

SUMMARY OF THE INVENTION

The present invention overcomes these drawbacks and provides a leveling linkage designed to permit one man to quickly and easily convert the linkage between geometries respectively conducive for usage with a fork lift and with a bucket.

The improved linkage structure in the preferred embodiment includes a knee plate assembly pivotally mounted to a knee location of a loader arm, the knee plate having a fixed pivot connection, to which a link extending from the loader arm support post is connected, and a second pivot connection to which a tilt cylinder is connected. The second pivot connection includes a pin carried by a locking cam and received in a fore-and-aft slot provided in the knee plate assembly, the cam being operable between a first position, wherein it retains the pin at one end of the slot in a bucket position, and a second position wherein it retains the pin at the other end of the slot in a fork lift position.

This knee plate structure permits one person to easily manipulate the locking cam between its first and second positions for respectively locating the tilt cylinder connection point at desired positions for respectively establishing linkage geometries for fork lift and bucket operation.

BRIEF DESCRIPTION OF THE DRAWINGS

FIG. 3 is an enlarged right side elevational view of the knee plate assembly shown in FIG. 1, with the locking cam being shown in solid lines in its bucket position and in dashed lines in its forklift position.

FIG. 4 is a top view of the knee plate assembly shown in FIG. 3.

Description of the Preferred Embodiment

Figure 1:
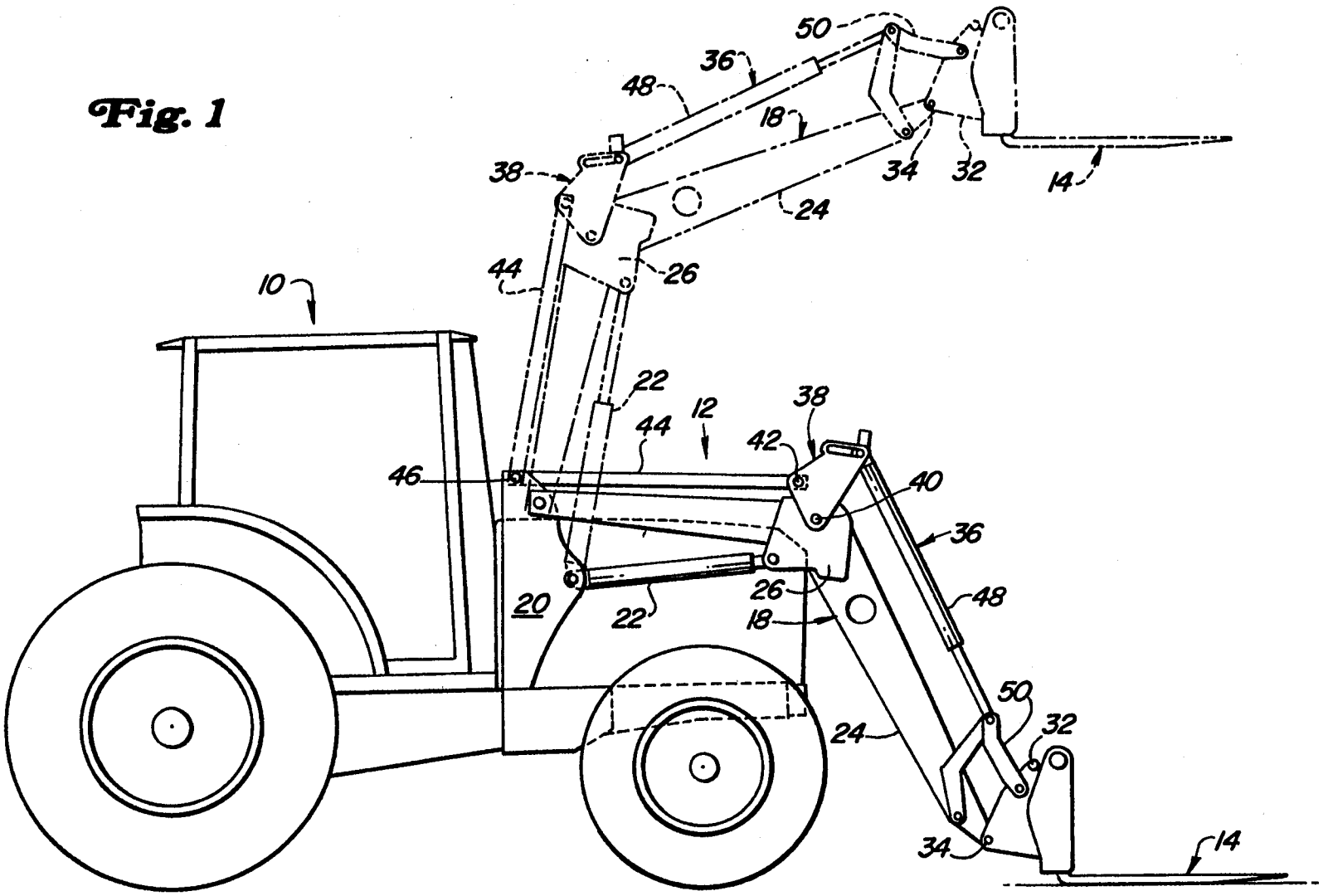
FIG. 1 is a right side elevational view of a tractor-mounted loader equipped with a fork lift and a leveling linkage having a knee plate assembly constructed in accordance with the present invention and shown in its condition for operation with the fork lift, the loader being shown in solid lines in a lowered position and being shown in broken lines in a raised position.
Figure 2:
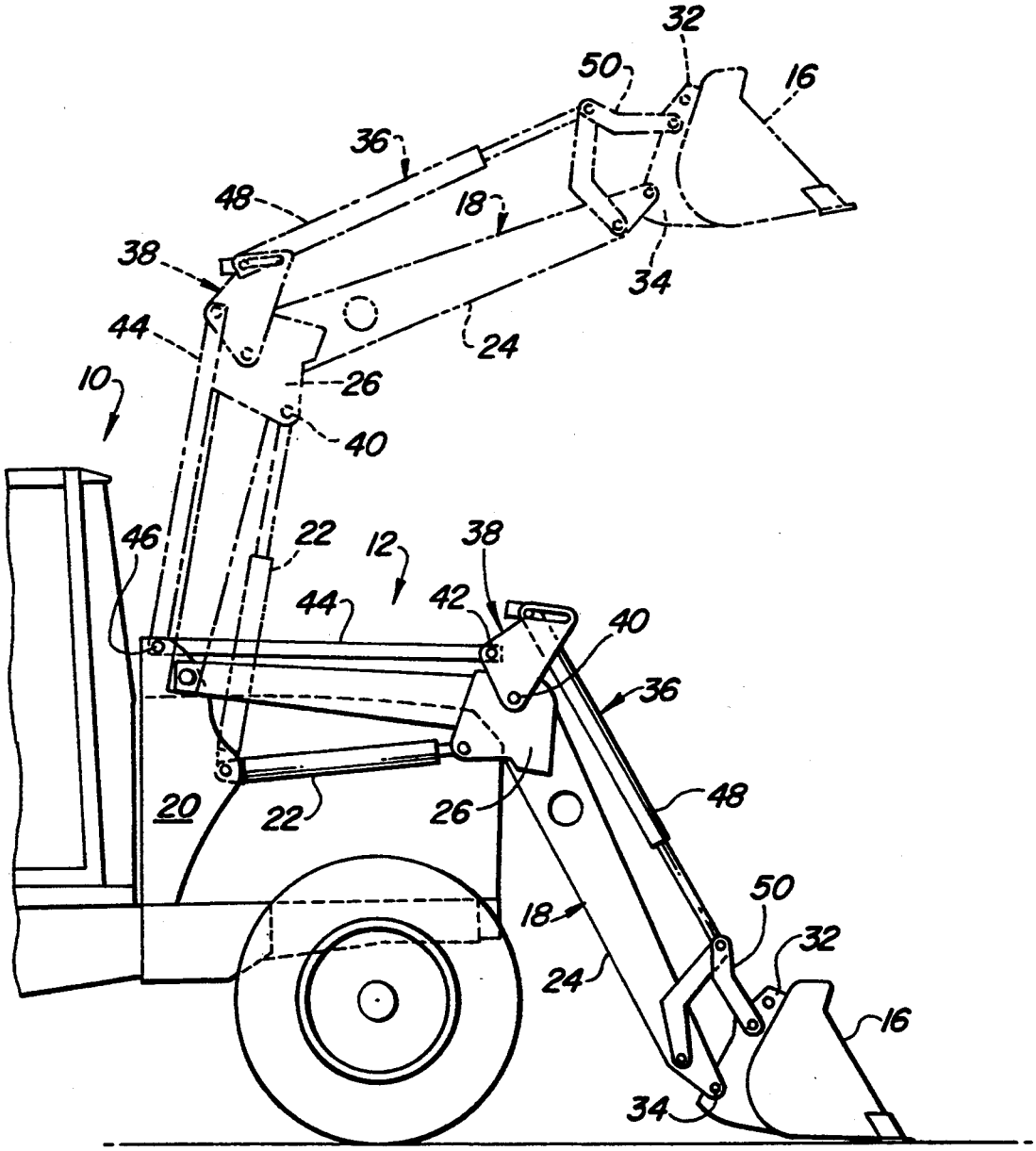
FIG. 2 is a right side elevational view showing the tractor-mounted loader of FIG. 1 equipped with a bucket and with the knee plate assembly shown in its condition for operation with the bucket.

Referring now to FIGS. 1 and 2, there is shown a tractor having a loader 12 connected thereto and being equipped with an attachment shown as a forklift 14 in FIG. 1 and shown as a bucket 16 in FIG. 2. However, it is to be understood that the present invention may be used with other attachments as well.

The loader 12 includes a boom 18 pivotally connected to upright masts or posts 20 for rocking in a conventional manner about a transverse axis by boom cylinders 22. As considered when the implements are resting on the ground, the boom 18 includes a pair of transversely spaced boom arms 24 extending forwardly from the posts 20 to knees 26. The arms 24 extend downwardly from the knees 26 to lower forward ends to which respective holders 32 of an attachment carrier are respectively vertically pivotally connected by a pair of pivot pins 34.

A leveling linkage 36 extends between the top of each post 20 to a respective one of the holders 32. Specifically, a knee plate pivot arm assembly 38, which, in side view, is substantially four-sided, has a lower corner pivotally connected to the arm knee 26 by a transverse plate assembly mounting pin 40, a rear corner pivotally connected, as by a transverse pivot pin 42, to a forward end of a link 44 having its rear end pivotally connected to the post 20 by a pivot pin 46. Pivotally connected to the upper end of the plate assembly 38, in a manner described below, is a head end of an implement tilt cylinder 48 having its rod end connected to a conventional tilt linkage 50 coupled between the loader arm 24 and the holder 32. It is here noted that the tilt cylinder serves as a rigid link when cooperating as part of the leveling linkage 36. To this point, the described structure is conventional.

Figure 5:
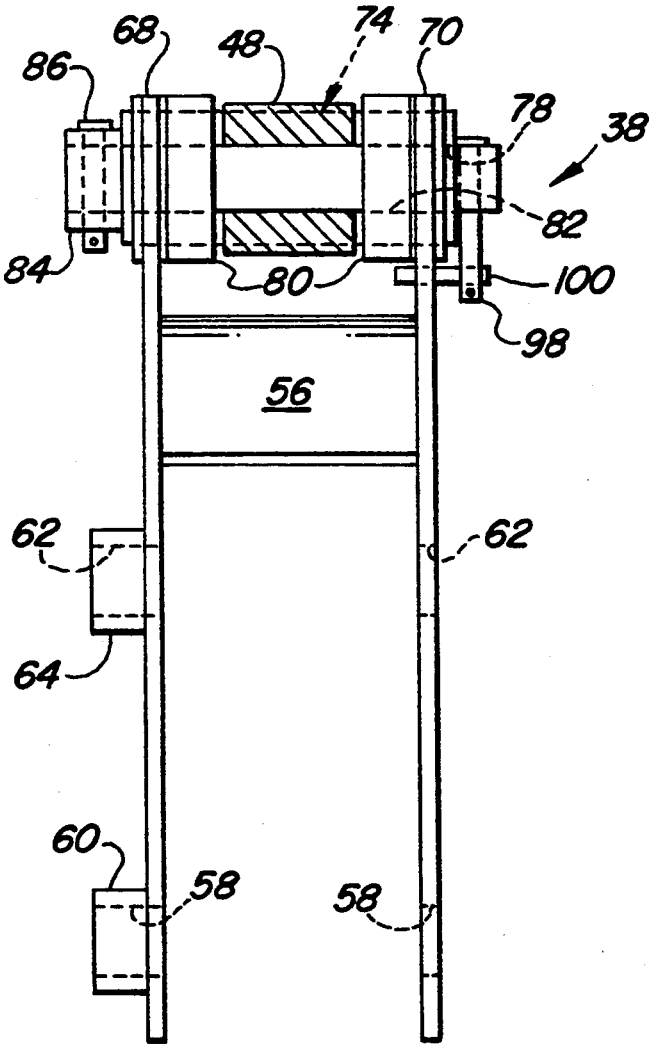
FIG. 5 is a front view of the knee plate assembly shown in FIG. 3.

The invention resides in the knee plate or pivot arm assembly 38 which, with reference to FIGS. 3–5 and considered by one facing forwardly from the rear of the loader, includes right and left plates 52 and 54, respectively, fixed in spaced parallel relationship to each other by an angular spacer plate 56 extending between and having its opposite sides welded to the plates. A pair of axially aligned holes 58 (FIG. 5) are provided in the lower corner of each of the right and left plates 52 and 54 and located on an outer face of the right plate in concentric relationship to the hole 58 is a cylindrical tubular receptacle 60. The knee 26 contains a transverse hole and the plates 52 and 54 straddle the knee with the assembly mounting pin 40 (FIGS. 1 and 2) being received in the aligned holes 58, the cross hole of the knee and in the receptacle 60. Similarly, a pair of axially aligned holes 62 are provided in a rear corner of each of the plates 52 and 54 and located on the outer face of the right plate 52 is a second cylindrical tubular receptacle 64. The link attachment pin 42 is received in the aligned holes 62 and in a hole provided in the forward end of the link 44, the latter being positioned between the plates 52 and 54.

Located in the upper portion of the knee plate assembly 38 is an elongate pivot pin adjustment slot or opening comprising identical elongate slot portions 66 located in transverse alignment with each other and extending fore-and-aft between upper front and rear corners of each of the plates 52 and 54. The slot portions 66 are disposed in parallel relationship to straight top edges 68 and 70 respectively of the plates 52 and 54. Received through the elongate opening portions 66 and in an eye carried by the head end of the tilt cylinder 48 and located between the plates 52 and 54 is a cylinder mounting or pivot pin 72. It is here noted that the cylinder eye carries a grease fitting 73 for permitting grease to be introduced at the interface of the eye and pin surfaces. A bucket position is defined by rear ends of the adjustment slot or opening portions 66, while the opposite or forward ends of the adjustment slot or opening portions defines a fork lift position. Thus, when the pin 72 is located in the bucket position (solid line position of FIG. 3 and position shown in FIG. 4), the geometry of the leveling linkage 36 is configured for operation with the bucket 16, this geometry resulting in the bucket becoming tilted slightly backward as it is elevated from its lowered solid line position to its broken line raised position as shown in FIG. 2. Similarly, when the pin 72 is located in the fork lift position (broken line position shown in FIG. 3), the geometry of the leveling linkage 36 is configured for operation with the forklift 14, this geometry resulting in the fork lift remaining level throughout the range of motion of the arms 24 between its lowered solid line position and its raised broken line position shown in FIG. 1.

Provided for the purpose of selectively locking the pin 72 in its bucket position is a pivot pin latch 74. The latch 74 comprises a U-shaped handle 76 formed from a bent strap and having opposite legs respectively located adjacent the outer surfaces of the plates 52 and 54. Axially aligned holes 78 are provided near the ends of the handle legs. A pair of L-shaped latching cams 80 are respectively welded to the pair of interior surfaces of the handle legs. Specifically, the cams 80 each include a short leg extending perpendicular to and being welded to a respective one of the handle legs and include a long leg extending parallel to the respective one of the handle legs. The long leg of each cam 80 contains a hole 82 aligned with the handle holes 78 and the cylinder mounting or pivot pin 72 is received through the aligned holes 78 and 82. The outer surface of the outer leg of the handle 76 has a cylindrical tubular receptacle 84 welded thereto in concentric relationship to the hole 78 and the pin 72 is kept from rotating relative to the handle 74 by a pivot pin rotation locking pin 86 received in aligned cross bores respectively provided in the receptacle 84 and pin 72. This ensures that pivotal movement between the eye of the cylinder 48 and the pivot pin 72 will be limited to the surfaces which receive grease from the fitting 73 thus minimizing wear between the pin and the eye. Formed on the upper rear corner of the knee plates 52 and 54 in symmetrical relationship to the longitudinal axis of the respective elongate adjustment slot portions 66 and on a radius about the pin 72, when the latter is in the bucket position, are arcuate latch surfaces 88 and 90, respectively. The short leg of each cam 80 is provided with a latch surface including an arcuate portion 92 located between and joined to flat portions 94 and 96. The arcuate latch surface portion 92 of each cam 80 is formed on a radius substantially equal to that of the latch surfaces 88 and 90 of the plates 52 and 54 so that when the latch handle 76 is in its downwardly rotated latched position, shown in solid lines in FIG. 3, the arcuate latch surface portions 92 of the cams 80 will respectively be engaged with the latch surfaces 88 and 90. The flat portions 94 and 96 of the latch surface of each of the cams 80 are located so as to come into engagement with the top edges 68 and 70 of the knee plates 52 and 54 when the handle 76 of the latch 74 is in its upwardly rotated unlatched position shown in broken lines in FIG. 3. This prevents the latch 74 from returning to its latched position unless the cylinder mounting pin 72 is first positioned in the rear ends of the slots 66. It is here noted that the mounting pin 72 is kept toward the forward ends of the slot portions 66 by the weight of the implement acting through the tilt cylinder 48.

For the purpose of preventing the latch 74 from accidentally rotating upwardly from its latched position, a latch locking pin 98 is slidably received in a vertical cross bore at the inner end of the pivot pin 72, the pin 98 extending a substantial distance below the pin 72. As can best be seen in FIGS. 3 and 4, a stop pin 100 projects horizontally through the knee plate 54 at a location where it contacts the rear side of the lower portion of the rotation locking pin 98 so as to prevent the latch handle 76 from being rotated clockwise from its latched position. In order to permit such clockwise rotation, it is necessary only to lift the locking pin 98 so that it clears the stop pin 100. It is here noted that counterclockwise rotation of the latch handle 76 is prevented by rear edges surfaces 102 and 104, respectively, of the knee plates 52 and 54.

While the pivot arm assembly 38 of the preferred embodiment is embodied in the leveling linkage 36 such that the adjustment slots 66 extend fore-and-aft and there is no need for a device for locking pivot pin 72 and hence the latch 74 in the forward end of the slots, it is to be understood that the principals of the invention could be applied to a leveling linkage of the type utilizing a cross over link in which case the pivot pin adjustment slot would extend lengthwise of the cross over link and devices would be provided for locking the pivot pin together with the latch 74 in desired positions at opposite ends of the adjustment slot.

The operation of the invention is now briefly stated. Specifically, assuming the loader arms to be equipped with a forklift as shown in FIG. 1, the latch handle 76 will be in its raised, unlatched position with the flat surfaces 94 and 96 of each cam 80 engaged with the top edges 68 and 70 of the knee plates 52 and 54. This prevents the latch 74 from moving to its latched position so long as the pivot pin 72 is located away from the rear ends of the adjustment slot portions 66. The appropriate geometry of the leveling linkage 36 for causing the forklift 14 to remain level throughout its movement between fully lowered and raised positions is obtained by lowering the forklift to a level support surface and then extending or retracting the tilt cylinders 48 until the entire length of the tines are engaged with the support surface. Since the tilt cylinders 48 are always pulling on the knee plate assemblies 38, the cylinder mounting pins 72 will remain in the forward ends of the adjustment slot portions 66 making it unnecessary to provide any sort of stop for preventing rearward movement of the latch members 74.

If it is then desired to use a bucket 16 with the loader instead of the forklift 14, the forklift will be disconnected from the holders 32 and the bucket connected thereto in a manner well known in the art. The bucket 16 is then rested flat on level ground or other level support surface and the tilt cylinders 48 extended until the pins 72 are located in the respective bucket positions at the rear of the adjustment slot portions 66. Each latch handle 76 of the pivot pin latches 74 is then rotated downwardly to its respective lowered, latched position while retaining the associated locking pin 98 elevated so as to clear the stop pin 100. The locking pin 98 is then released with the stop pin 100 then acting to prevent the latch 74 from rotating from its latched position. This repositioning of the tilt cylinder mounting pins 72 will result in the geometry of the leveling linkages 36 being such as to effect a slight rearward tilting of the bucket 16 as it is elevated from its lowered solid line position to its raised broken line position shown in FIG. 2.

During operation either with the forklift 14 or bucket 16 attached to the leveling linkages 36, pivot pin wear is minimized by the fact that the pivot pin rotation locking pins 86 prevent pivotal movement of the cylinder mounting pins 72 to the latches 74 thus ensuring that relative pivotal movement occurs only at the area between the eyes of the tilt cylinders 48 and the mounting pins 72 which is lubricated by introducing grease through the fitting 73.

Thus, it will be appreciated that the construction of the knee plate or pivot arm assemblies 38 and the latches 74 makes it possible to easily convert the leveling linkages 36 between respective geometries for use with forklift or bucket implements without the need for tools of any kind.

I claim:

1. In a tractor-mounted loader including a pair of laterally spaced, parallel boom arms having rear ends respectively pivotally mounted to a pair of support posts and having forward ends adapted for having various types of implements pivotally attached thereto, a lift cylinder connected between each support post and the boom arm associated therewith for moving the boom arms between lowered and raised positions, a leveling linkage associated with each boom arm and including a pivot arm assembly and first and second elongated links with the pivot arm assembly carrying first, second and third pivotal connections coupled respectively to the associated boom arm, at a location between opposite ends thereof, to a first end of the first motion transfer link and to a first end of the second motion transfer link, the first and second motion transfer links having second ends respectively pivotally connected to an associated one of the support posts and adapted for connection to a selected type of implement, the leveling linkages being adapted for effecting pivoting of the selected type of implement about its pivotal connections with the boom arms in response to the boom arms being raised and lowered by the lift cylinders, the improvement comprising: said pivot arm assembly being provided with an elongate pivot adjustment slot; one of the second and third pivotal connections being located in said elongate slot; and releasable latch means for selectively fixing said one of the second and third pivotal connections at a desired first location in said elongate slot for establishing a preselected first geometry in said leveling linkage adapted for effecting tilting of the implement through a first range of motion when the latter is of a first type; and said latch means being releasable for permitting said one of the second and third pivotal connections to move to a second desired location in said slot for effecting a second preselected geometry in said leveling linkage for effecting a preselected second geometry in said leveling linkage adapted for effecting tilting of the implement through a second range of motion when the latter is of a second type.

2. The loader defined in claim 1 wherein said one of the second and third pivotal connections includes an adjustable pivot pin; said releasable latch means includes at least one latching cam mounted to said adjustable pivot pin for pivotal movement thereabout between latched and unlatched positions; said pivot arm assembly having a locking surface located in the vicinity of said first location in said elongate slot; and said one latching cam including a latch surface being engaged with and cooperating with said locking surface, only when the latching cam is in its latched position, for retaining the adjustable pivot pin in said first desired location in said elongate slot.

3. The loader defined in claim 2 wherein said latch means includes latch lock means for releasably retaining said one latching cam in its latched position.

4. The loader defined in claim 3 wherein said latch lock means includes a latch locking pin shiftably mounted in said adjustable pivot pin for movement between locking and releasing positions; and a stop carried by said pivot arm assembly and being in the path of movement of said latch locking pin only when the latter is in its locking position and being rotated with said latching cam between its latched and unlatched position, the locking pin, when shifted to its releasing position, being free of the stop and permitting free rotation of the latching cam between its latched and unlatched positions.

5. The loader defined in claim 4 wherein said stop is in the form of a stop pin extending perpendicular to said locking pin.

6. The loader defined in claim 2 wherein said first desired location is in an end of said slot and said latch and locking surfaces being formed arcuately at a fixed radius about said adjustable pivot pin when the latter is in said first desired location.

7. The loader defined in claim 6 wherein said locking surface is formed symmetrically relative to said elongate slot.

8. The loader defined in claim 6 wherein said first, second and third pivot connections are in a triangular arrangement in said pivot arm assembly; and said elongate slot extending fore-and-aft in said pivot arm assembly.

9. The loader defined in claim 8 wherein said third pivotal connection is the one located in said slot; and said first and second desired locations in said slot respectively being in rear and forward ends of said slot.

10. The loader defined in claim 8 wherein said pivot arm assembly includes at least one plate having a lower corner containing said first pivotal connection, a rear corner containing said second pivotal connection, and upper rear and forward corners; and said elongate slot extending between said upper rear and forward corners of said plate.

11. The loader defined in claim 10 wherein said locking surface is formed at said upper rear corner of said plate.

12. The loader defined in claim 1 wherein said pivot arm assembly includes a pair of identical plates fixed in parallel relationship to each other; said plates having lower corners containing said first pivotal connection, rear corners containing said second pivotal connection, and upper forward and rear corners; said elongate slot including identical slot portions extending between said upper forward and rear corners of each plate; and said third pivotal connection being mounted in said slot portions.

13. The loader defined in claim 12 wherein said third pivotal connection includes an adjustable pivot pin extending between said plates and through said slot portions; said latch means including a pair of latching cams respectively pivotally mounted on said adjustable pivot pin adjacent said pair of plates; said plates each having a locking surface formed thereon at a location adjacent said first desired location; and said latching cams each having a latching surface thereon with the latching cams being pivotable about said adjustable pivot pin between a latched position, wherein the latching surfaces thereof respectively engage the locking surfaces carried by said plates for retaining the adjustable pivot pin in said first desired location, and an unlatched position wherein said latching surfaces are free of said locking surfaces.

14. The loader defined in claim 13 wherein said latching and locking surfaces are formed on a radius about said adjustable pivot pin when the latter is in said first desired location.

15. The loader defined in claim 13 wherein said first desired location is at a rear end of said slot and said latching and locking surfaces being arranged symmetrically relative to said slot.

16. The loader defined in claim 15 wherein said second desired location is in a forward end of said slot; said plates each having an upper edge extending parallel to said slot portions; and said latching surface of said each latching cam having a central portion engageable with said locking surface of the adjacent plate only when the latching cam is in its latched position and straight surface portions located on opposite sides of said central surface portion engageable with said upper edge of the adjacent plate only when the latching cam is moved to its unlatched position.

17. The loader defined in claim 13 wherein said latch means includes a U-shaped handle having a pair of legs pivotally mounted on said adjustable pin at respective locations adjacent the plates; said latching cams having long legs extending parallel to said plates and being pivotally mounted to the adjustable pivot pin at locations on the opposite sides of the plates from pivotal mounting of the handle legs on the pin; and said pair of latching cams each having a portion extending at a right angle to the leg and having said latching surface formed thereon.

18. The loader defined in claim 17 and further including pivot pin fixing means for preventing rotation of said adjustable pivot pin relative to said latching cams; said adjustable pivot pin having an end projecting beyond an outer surface of one of said plates and containing an upright throughbore; a latch position retainer pin being slidably mounted in said throughbore for movement between a raised release position and a lowered retain position and including means for preventing the retainer pin from escaping downwardly through said throughbore; said retainer pin extending downwardly beyond the pivot pin when the retainer pin is in its retain position; and a stop means fixed to and projecting outwardly from said one of the plates to a position adjacent a lower end portion of said retainer pin, when the latter is in its retain position, for preventing pivotal movement of the latching cams from their latch position, the retainer pin being free of the stop means when the retainer pin is moved to its raised position so as to permit pivotal movement of said latching cams to their unlatch position.

19. The loader defined in claim 18 wherein said stop means is a stop pin projecting from said one of said plates at a right angle to said retainer pin.

* * * * *